US009620323B1

(12) United States Patent
Tatsuda et al.

(10) Patent No.: US 9,620,323 B1
(45) Date of Patent: Apr. 11, 2017

(54) VACUUM TUBE

(71) Applicants: NORITAKE ITRON CORPORATION, Mie (JP); NORITAKE CO., LIMITED, Aichi (JP); KORG INC., Tokyo (JP)

(72) Inventors: Kazunori Tatsuda, Mie (JP); Tadami Maeda, Mie (JP); Misa Yamanaka, Mie (JP); Fumio Mieda, Tokyo (JP)

(73) Assignees: NORITAKE ITRON CORPORATION, Mie (JP); NORITAKE CO., LIMITED, Aichi (JP); KORG INC., Tokyo (JP)

( * ) Notice: Subject to any disclaimer, the term of this patent is extended or adjusted under 35 U.S.C. 154(b) by 0 days.

(21) Appl. No.: 15/388,328

(22) Filed: Dec. 22, 2016

Related U.S. Application Data

(63) Continuation of application No. 15/000,353, filed on Jan. 19, 2016.

(30) Foreign Application Priority Data

Jan. 20, 2015 (JP) ..... 2015-008346

(51) Int. Cl.
*H01J 17/24* (2012.01)
*H01J 19/70* (2006.01)
(Continued)

(52) U.S. Cl.
CPC ..... *H01J 19/38* (2013.01); *H01J 19/08* (2013.01); *H01J 19/12* (2013.01); *H01J 19/32* (2013.01)

(58) Field of Classification Search
CPC .. H01J 19/70; H01J 21/10; H01J 19/38; H01J 19/32
See application file for complete search history.

(56) References Cited

U.S. PATENT DOCUMENTS 4,100,455 A * 7/1978 DuBois ..... H01J 31/15 313/111
4,206,404 A 6/1980 DuBois
(Continued)

FOREIGN PATENT DOCUMENTS

JP S49-005240 2/1974
JP 2007-042480 2/2007

OTHER PUBLICATIONS

Noritake Itron Corporation, "Guide to VFD Operation Application Note Drive Characteristic", Dec. 19, 2014, https://www.noritake-itron.jp/cs/appnote/apf100_vfd/apf201_houshiki.html.
(Continued)

*Primary Examiner* — Donald Raleigh
(74) *Attorney, Agent, or Firm* — Greenblum & Bernstein, P.L.C.

(57) ABSTRACT

A vacuum tube includes a filament and two pairs of a grid and an anode. The filament is tensioned linearly and emits thermoelectrons. Both of the anodes are formed on a same face on a planar substrate. The filament is arranged parallel to the planar substrate at a position facing both of the anodes. Each of the grids is arranged, such that the grid faces the anode of a same pair at a first predetermined distance from the anode and has a second predetermined distance from the filament, between the anode and the filament. The vacuum tube further includes an intermediate filament fixing part fixing the filament at a position corresponding to an intermediate point between the anodes of the two pairs.

3 Claims, 5 Drawing Sheets

(51) Int. Cl.

| | |
|---|---|
| ***H01J 61/26*** | (2006.01) |
| ***H01J 19/38*** | (2006.01) |
| ***H01J 19/12*** | (2006.01) |
| ***H01J 19/32*** | (2006.01) |
| ***H01J 19/08*** | (2006.01) |

(56) References Cited

U.S. PATENT DOCUMENTS

| | | | | |
|---|---|---|---|---|
| 4,218,636 | A * | 8/1980 | Miyazawa | H01J 31/15 313/497 |
| 4,791,337 | A * | 12/1988 | Murata | G09G 3/06 315/168 |
| 5,204,583 | A | 4/1993 | Jeong | |
| 5,312,279 | A | 5/1994 | Jang | |
| 5,459,374 | A * | 10/1995 | Thoeny | B60K 35/00 315/169.1 |
| 5,903,097 | A | 5/1999 | Lee | |
| 6,452,329 | B1 | 9/2002 | Jang | |
| 6,822,387 | B1 | 11/2004 | Park | |
| 6,943,487 | B1 | 9/2005 | Ryu | |
| 2002/0140340 | A1 | 10/2002 | Mohri et al. | |
| 2004/0051442 | A1 * | 3/2004 | Kanesaka | H01J 31/126 313/493 |
| 2004/0100185 | A1 | 5/2004 | Lee et al. | |
| 2004/0207574 | A1 | 10/2004 | Arai et al. | |
| 2005/0140267 | A1 * | 6/2005 | Maeda | H01J 29/90 313/493 |
| 2011/0279425 | A1 * | 11/2011 | Maeda | H01J 31/126 345/206 |

OTHER PUBLICATIONS

U.S. Appl. No. 15/000,392 to Kazunori Tatsuda et al., which was filed on Jan. 19, 2016.

* cited by examiner

VACUUM TUBE

CROSS REFERENCE TO RELATED APPLICATIONS

This is a continuation application of U.S. patent application Ser. No. 15/000,353, filed on Jan. 19, 2016, which claims the benefit of Japanese Patent Application No. 2015-008346, filed on Jan. 20, 2015. The entire disclosure of each of the above-identified applications, including the specification, drawings, and claims, is incorporated herein by reference in its entirety.

TECHNICAL FIELD

The present invention relates to a vacuum tube which operates as an analog amplifier.

BACKGROUND ART

A vacuum fluorescent display is known as a technique related to a vacuum tube, and, for example, structures shown in Japanese Utility Model Publication No. 49-5240 (hereinafter referred to as "Patent Literature 1") and Japanese Patent Application Laid Open No. 2007-42480 (hereinafter referred to as "Patent Literature 2") are known. In Patent Literature 1, a linearly tensioned filament which emits thermoelectrons at a predetermined temperature or higher is referred to as "a heater H". An anode arranged parallel to the filament ("a positive pole 4" in Patent Literature 1), and a grid arranged between the filament and the anode such that the grid faces the anode are provided (see FIGS. 1 and 2 of Patent Literature 1). A basic structure in Patent Literature 2 is the same as that of Patent Literature 1. As a control method for the vacuum fluorescent display shown in Patent Literatures 1 and 2, a driving system shown in "Vacuum Fluorescent Display (VFD) General Application Notes—Driving Method—Driving system" by NORITAKE ITRON CORP, searched on the Internet (<https://wvvw.noritake-itron.jp/cs/appnote/apf100_vfd/apf201_houshiki.html>) on Dec. 19, 2014 (hereinafter referred to as Reference Document 1) is known.

SUMMARY OF THE INVENTION

Because there is a demand from users who like characteristics of a vacuum tube mainly in the music industry, there is a demand for a vacuum tube to be used as an analog amplifier, and a vacuum tube which can be used as an analog amplifier exists. For most of general analog amplifiers, however, a semiconductor such as a transistor and an operational amplifier is used. Therefore, the quantity of production of vacuum tubes to be used as analog amplifiers decreases, and there are problems of increase in price and difficulty in availability. On the other hand, a vacuum fluorescent display, which is a kind of vacuum tube and is available inexpensively, is digitally controlled as is known from the driving system shown in Reference Literature 1 and is not designed for use as an analog amplifier. Therefore, the vacuum fluorescent display is not easily used for analog amplification.

An object of the present invention is to provide a vacuum tube with a structure close to that of an inexpensive and easily available vacuum fluorescent display, which is easy to use as an analog amplifier for a sound signal.

The vacuum tube of the present invention comprises a filament and two pairs of a grid and an anode. The filament is tensioned linearly and emitting thermoelectrons. Both of the anodes are formed on the same face on a planar substrate. The filament is arranged parallel to the planar substrate at a position facing both of the anodes. Each of the grids is arranged, such that the grid faces the anode in the same pair at a first predetermined distance from the anode and has a second predetermined distance from the filament, between the anode and the filament. The vacuum tube of the present invention further comprises an intermediate filament fixing part fixing the filament at a position corresponding to an intermediate point between the anodes of the two pairs.

According to the vacuum tube of the present invention, it is easy to increase a fundamental frequency of vibration of the filament because the filament is intermediately fixed. In other words, since it is easy to bring noises generated by the vibration of the filament to a frequency insensible to a person, the vacuum tube is easy to use as an analog amplifier for sound signal.

DETAILED DESCRIPTION OF THE EMBODIMENT

Figure 1:
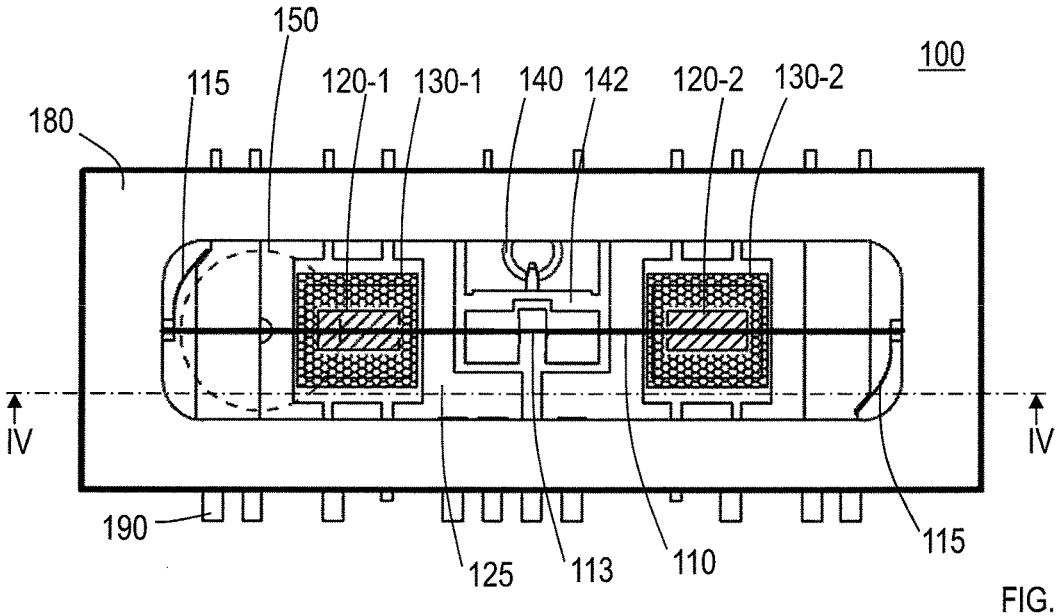
FIG. 1 is a plan view of a vacuum tube of a first embodiment.

An embodiment of the present invention will be described below in detail. Components having the same function are given the same reference numerals, and repeated description will be omitted.

First Embodiment

Figure 2:
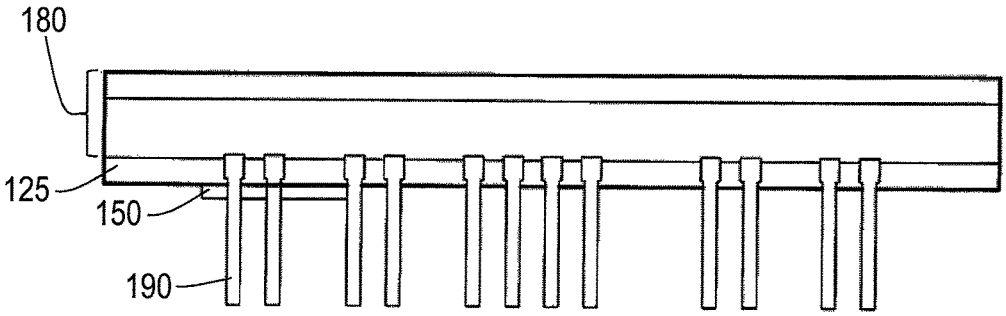
FIG. 2 is a front view of the vacuum tube of the first embodiment.
Figure 3:
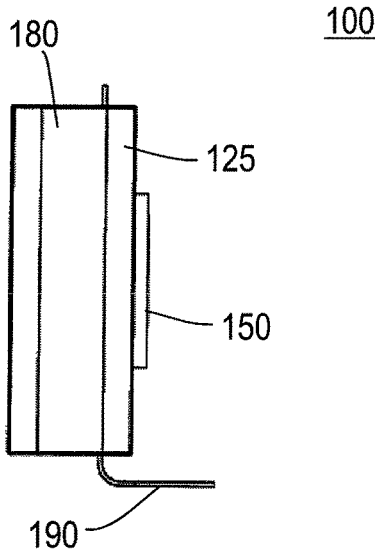
FIG. 3 is a side view of the vacuum tube of the first embodiment.
Figure 4:
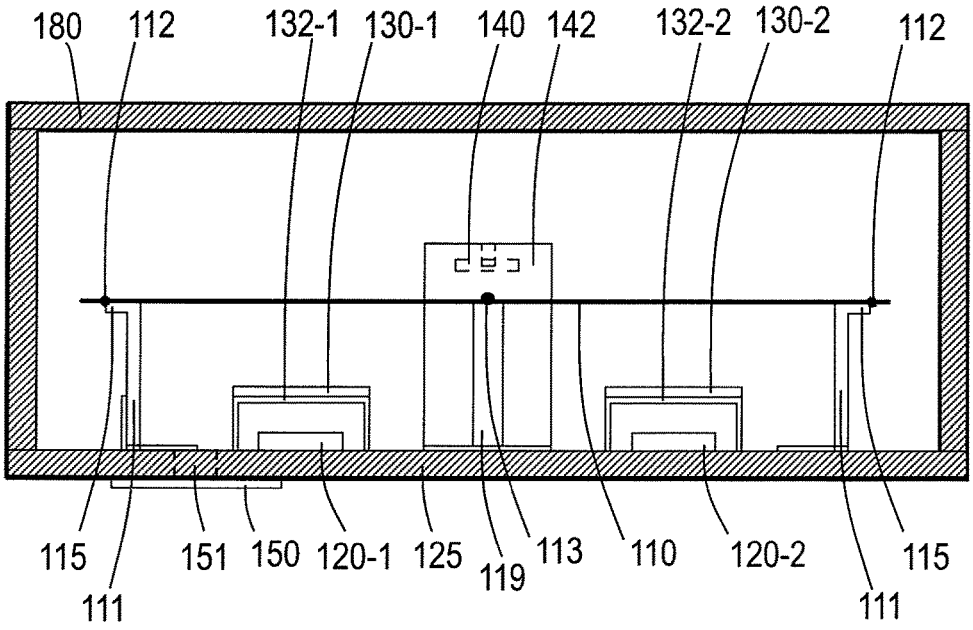
FIG. 4 is a cross-sectional view at a IV-IV line in FIG. 1.

A plan view, front view and side view of a vacuum tube of the present invention are shown in FIG. 1, FIG. 2 and FIG. 3, respectively, and a cross-sectional view at a IV-IV line in FIG. 1 is shown in FIG. 4. FIG. 4 is vertically enlarged so that a structure can be easily understood. Though the ratio of vertical direction to horizontal direction is different between FIG. 2 and FIG. 4, it is actually the same. A vacuum tube 100 comprises: a filament 110 which is tensioned linearly and emits thermoelectrons at a predetermined temperature or higher, and two pairs, a pair of a grid 130-1 and an anode 120-1 and a pair of a grid 130-2 and an anode 120-2. The anodes 120-1, 120-2 are formed on the same face of a glass substrate 125, which is a planar substrate. The filament 110 is arranged parallel to the glass substrate 125, which is a planar substrate, at a position facing both of the anodes 120-1, 120-2. The grids 130-1, 130-2 are arranged between the anodes 120-1, 120-2 and the filament 110, respectively, such that the grids 130-1, 130-2 face the anodes 120-1, 120-2 in the same pairs as the grids 130-1, 130-2, respectively, at a first predetermined distance from the anodes 120-1, 120-2 and have a second predetermined distance from the filament 110. The vacuum tube 100 further comprises an intermediate filament fixing part 113 fixing the filament 110 at a position corresponding to an intermediate point between the anodes 120-1, 120-2 of the two pairs. If the first predetermined distance is between 0.15 mm and 0.35, including 0.15 mm and 0.35, and the second predetermined distance is between 0.2 mm and 0.6 mm, including 0.2 mm and 0.6 mm, the vacuum tube may easily be utilized for analog amplification. Parts of the grids 130-1, 130-2 are not shown in FIG. 1 so that positions of the anodes 120-1, 120-2 are recognized. In the actual vacuum tube 100, the anodes 120-1, 120-2 are difficult to see because the mesh-type grids 130-1, 130-2 (see FIG. 9) exist on the anodes 120-1, 120-2.

Figure 5:
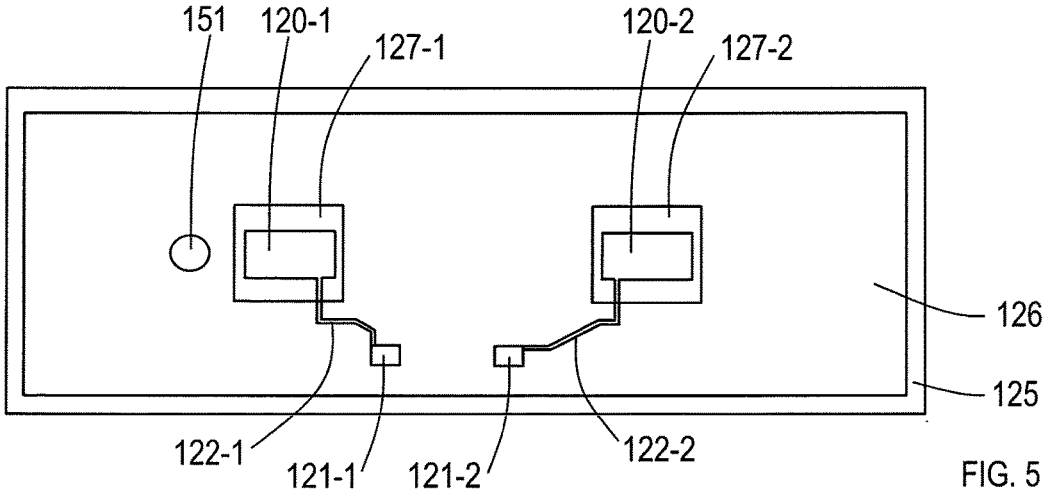
FIG. 5 is a diagram showing that anodes and an insulating layer are formed on a glass substrate.
Figure 6:
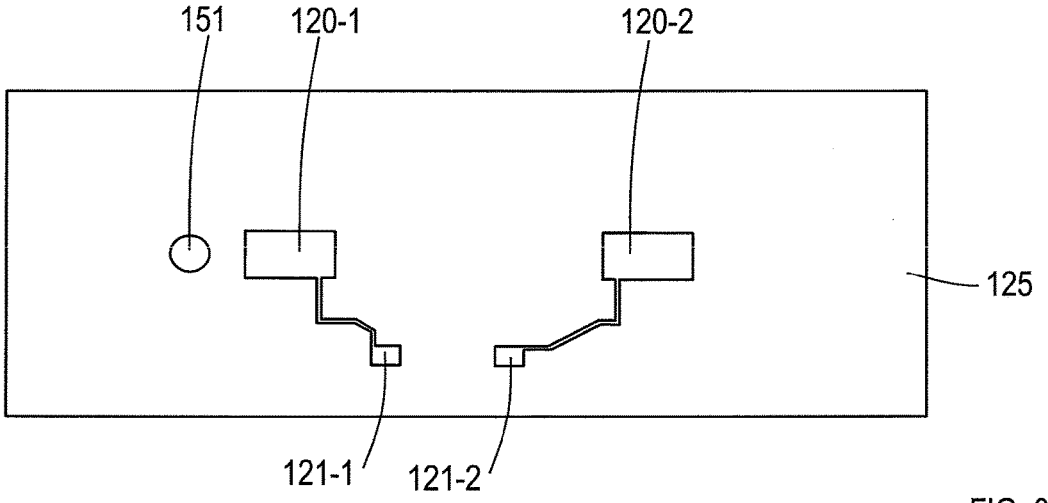
FIG. 6 is a diagram showing that the anodes are formed on the glass substrate.
Figure 7:
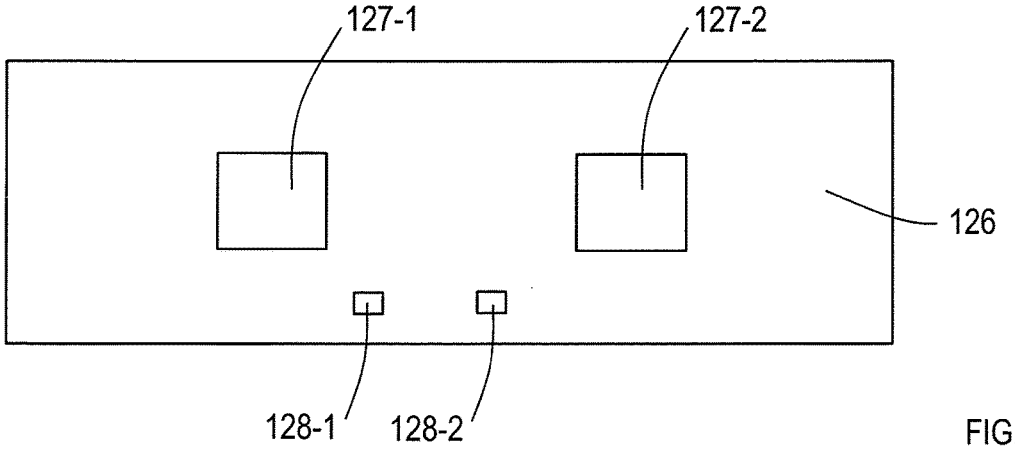
FIG. 7 is a diagram showing the shape of the insulating layer.

Next, a specific example of a structure for realizing the above features will be described. FIG. 5 shows that the anodes 120-1, 120-2 and an insulating layer are formed on a glass substrate. FIG. 6 is a diagram showing that the anodes 120-1, 120-2 are formed on the glass substrate. FIG. 7 is a diagram showing the shape of the insulating layer. The glass substrate 125 has an exhaust hole 151. The anodes 120-1, 120-2 are formed on one face of the glass substrate 125. Anode terminals 121-1, 121-2 are connected to the anodes 120-1, 120-2. The anodes 120-1, 120-2 can be formed, for example, with a thin film of aluminum. For an insulating layer 126, for example, low-melting-point glass can be used, and the insulating layer 126 has anode openings 127-1, 127-2 and terminal openings 128-1, 128-2. The vacuum tube 100 is evacuated by sealing a case 180 and the glass substrate 125 and evacuating air through the exhaust hole 151. Then, an exhaust hole plug 150 is fitted in the exhaust hole 151. Low-melting-point glass for sealing may be further arranged on a part of the glass substrate 125 to be in contact with the case 180 though it is not shown in FIG. 5. Electrical contact with the outside is achieved by a terminal 190.

Figure 8:
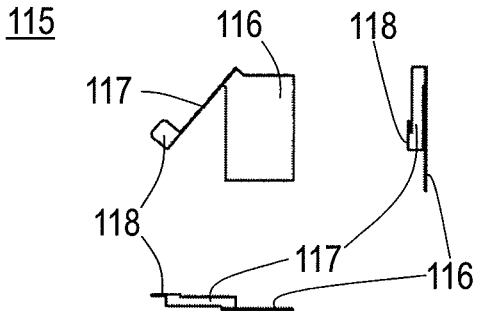
FIG. 8 shows three views (a plan view, a front view and a side view) of an anchor.

The filament 110 is a directly heated cathode. For example, the filament 110 can be coated with barium oxide so that thermoelectrons are emitted when the filament 110 is heated to about 650 degrees by causing a direct current to flow. In this example, the "predetermined temperature or higher" described above is 650 degrees, but the temperature is not limited to 650 degrees. FIG. 8 shows three views (a plan view, front view and side view) of an anchor 115 for giving tension to the filament 110. One end of a plate spring 117 is arranged on a part of an anchor body 116, and the other end of the plate spring 117 is a filament fixing part 118. For the anchor 115, SUS (stainless steel material) or the like can be used. The anchors 115 are fitted to filament support members 111, and the filament 110 is fixed to the filament fixing parts 118 of the anchors 115 by welding or the like. Reference numeral 112 in FIG. 4 indicates welding points. At a position corresponding to an intermediate point between the anodes of the two pairs, an intermediate filament support member 119 is attached. The intermediate filament fixing part 113 is formed by fixing the filament 110 to the intermediate filament support member 119 by welding or the like. A distance between the filament 110 and the anodes 120-1, 120-2 is determined by the lengths of the filament support members 111 and the intermediate filament support member 119, and the tension of the filament 110 can be adjusted by the plate springs 117 of the anchors 115.

The filament 110 is heated by a direct current flowing and heated to a predetermined temperature at which thermoelectrons can be emitted or higher. Near the welding points 112 and the intermediate filament fixing part 113, however, the temperature of the filament 110 cannot be heated to the predetermined temperature at which thermoelectrons can be emitted or higher because of heat transfer to the filament support member 111 and the intermediate filament support member 119. Therefore, a center of each of the grids 130-1, 130-2 faces a position corresponding to ¼ of the filament 110 from one end of the filament 110 (one of the welding points 112), and the intermediate filament fixing part 113 can be located at a position that divides the filament 110 into two halves (a middle point between the two welding points 112). With such an arrangement, the filament 110 facing the anodes 120-1, 120-2 can be located at a position farthest from the filament support member 111 and the intermediate filament support member 119, and, therefore, it is possible to efficiently utilize the thermoelectrons emitted from the filament 110.

Figure 9:
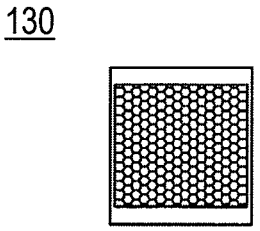
FIG. 9 is a diagram showing an example of the shape of a grid.

FIG. 9 shows an example of the shape of a grid. A grid 130 is mesh-shaped and can be formed with SUS or the like. As described above, parts of the grids 130 are not shown in FIG. 1 in order to show the anodes 120-1, 120-2 recognizably. The actual grids 130-1, 130-2 are the grid 130 shown in FIG. 9. Further, the grids 130-1, 130-2 are fixed to grid support members 130-1, 132-2. The distance between the anodes 120-1, 120-2 and the grids 130-1, 130-2 and the distance between the filament 110 and the grids 130-1, 130-2 are determined according to board thickness of the grid support members 132-1, 132-2.

Specifically, in the vacuum tube 100, the distance between the anodes 120-1, 120-2 and the grids 130-1, 130-2 (the first predetermined distance), which is between 0.15 mm and 0.35 mm, including 0.15 mm and 0.35 mm, is realized by the grid support members 132-1, 132-2. The distance between the filament 110 and the grids 130-1, 130-2 (the second predetermined distance), which is between 0.2 mm and 0.6 mm, including 0.2 mm and 0.6 mm, is realized by the filament support members 111, the intermediate filament support member 119 and the grid support members 132-1, 132-2.

Figure 10:
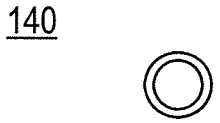
FIG. 10 is a diagram showing a getter ring.

FIG. 10 shows a getter ring 140. The getter ring 140 is responsible for enhancing a degree of vacuum or keeping the degree of vacuum by flushing induced by high frequency induction heating and depositing a metallic barium film on a part of the case 180. A getter shield 142 is a member for masking the getter ring 140 against the filament 110, the grids 130-1, 130-2 and the anodes 120-1, 120-2. In the case of a vacuum fluorescent display, influence to the characteristics of an indicator can be ignored no matter where the getter ring is arranged in the case, and, therefore, it is not necessary to consider a position of the getter ring from a viewpoint of the characteristics. However, it turned out that, in the case of using two pairs, the pair of the anode 120-1 and the grid 130-1 and the pair of the anode 120-2 and the grid 130-2, as amplifiers for stereo signals, the influence of the getter ring 140 cannot be ignored in order to balance the characteristics of the two pairs of amplifiers. Therefore, it is desirable to arrange the getter ring 140 at equal distances from the grids 130-1, 130-2 in order to balance the characteristics of the two pairs of amplifiers.

Figure 11:
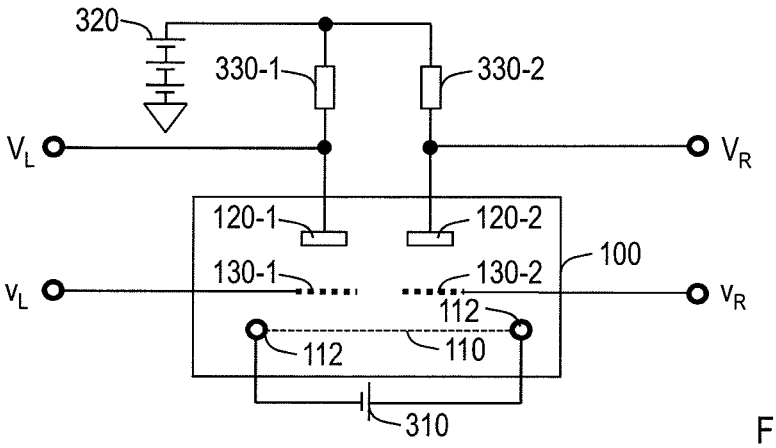
FIG. 11 is a diagram showing an example of an amplification circuit using the vacuum tube.

FIG. 11 shows an example of an amplification circuit using the vacuum tube 100. A DC voltage source 310 (for example, 0.7 V) is connected to the filament 110, and the filament 110 is heated to a predetermined temperature at which thermoelectrons are emitted (for example, 650 degrees). An anode voltage source 320 is applied to the anodes 120-1, 120-2 via resistances 330-1, 330-2. Then, for example, a signal $v_L$ of a left channel of a stereo to which a predetermined bias is added is input to the grid 130-1, and a signal $v_R$ of a right channel of the stereo to which the same bias is added is input to the grid 130-2. In this case, a voltage $V_L$ of the anode terminal 121-1 is an output for the left channel, and a voltage $V_R$ of the anode terminal 121-2 is an output for the right channel.

Figure 12:
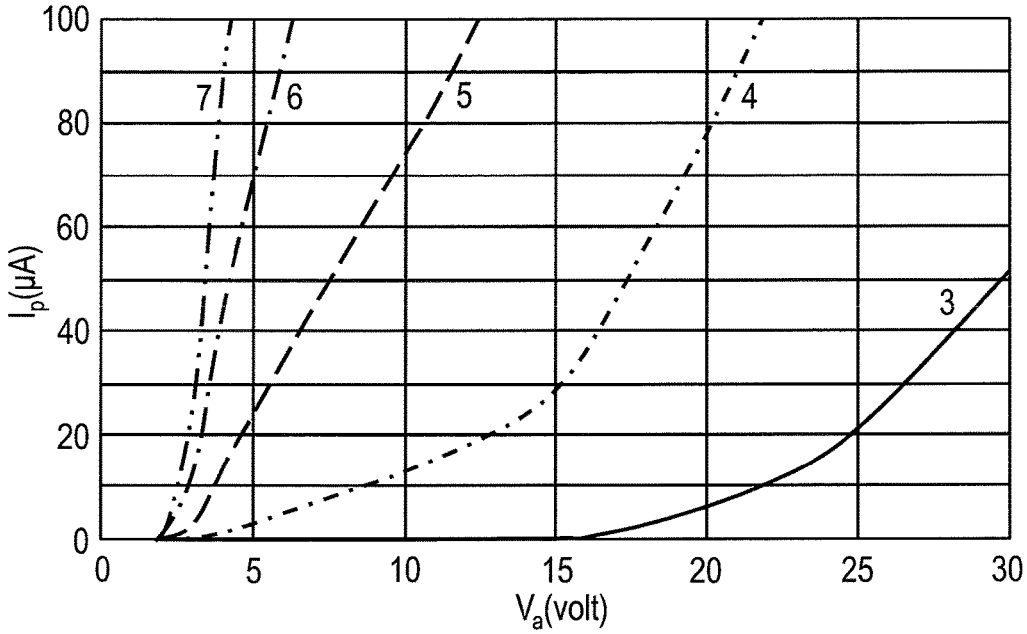
FIG. 12 is a diagram showing a relationship between an anode voltage $V_a$ and a current $I_p$ in a vacuum fluorescent display for each voltage of the grid.

Next, the necessity of the first predetermined distance and the second predetermined distance of the present invention will be described. A general vacuum fluorescent display also comprises: a filament which is tensioned linearly and emits thermoelectrons at a predetermined temperature or higher, an anode arranged parallel to the filament, and a grid arranged between the filament and the anode such that the grid faces the anode. In the general vacuum fluorescent display, however, a distance between the anode and the grid is about 0.5 mm or more, and a distance between the filament and the grid is about 1.0 mm or more. Further, the fundamental frequency of the characteristic vibration of the filament is not considered. In the case of the vacuum fluorescent display, ON/OFF control is performed, and, therefore, it is necessary to avoid a current from flowing insufficiently when the voltage of the grid is changed. That's why the above lengths are adopted. FIG. 12 shows a relationship between an anode voltage $V_a$ and a current $I_p$ in a vacuum fluorescent display for each voltage. Numerical values shown beside lines in FIG. 12 indicate the voltage of the grid. In the vacuum fluorescent display used in this experiment, the distance between the anode and the grid is about 0.5 mm, and the distance between the filament and the grid is about 1.0 mm. When the anode voltage $V_a$ is 10V, an insufficient current flows if the voltage of the grids is in the vicinity of 4V. The current is turned off if the voltage of the grid is 3V or below and turned on if the voltage of the grid is 5V or higher. Even if the voltage of the grid is changed in the vicinity of 4V, a range within which linearity can be obtained is thought to be narrow, and as can be seen, it is not easy to utilize the vacuum fluorescent display for analog amplification. There is a possibility that a region where linearity can be obtained exists in a region where the anode voltage $V_a$ is higher than 30V. However, since it is necessary to continuously apply anode voltage in order to utilize the vacuum fluorescent display as an analog amplifier, the anode voltage $V_a$ cannot be so increased given the influence of thermal expansion. In addition, in the case of using the vacuum fluorescent display as a vacuum fluorescent display, it is not necessary to continuously apply anode voltage because human afterimage is also utilized. In other words, it is also a cause of difficulty in utilization as an analog amplifier in comparison with utilization as a vacuum fluorescent display that the anode voltage cannot be increased.

Figure 13:
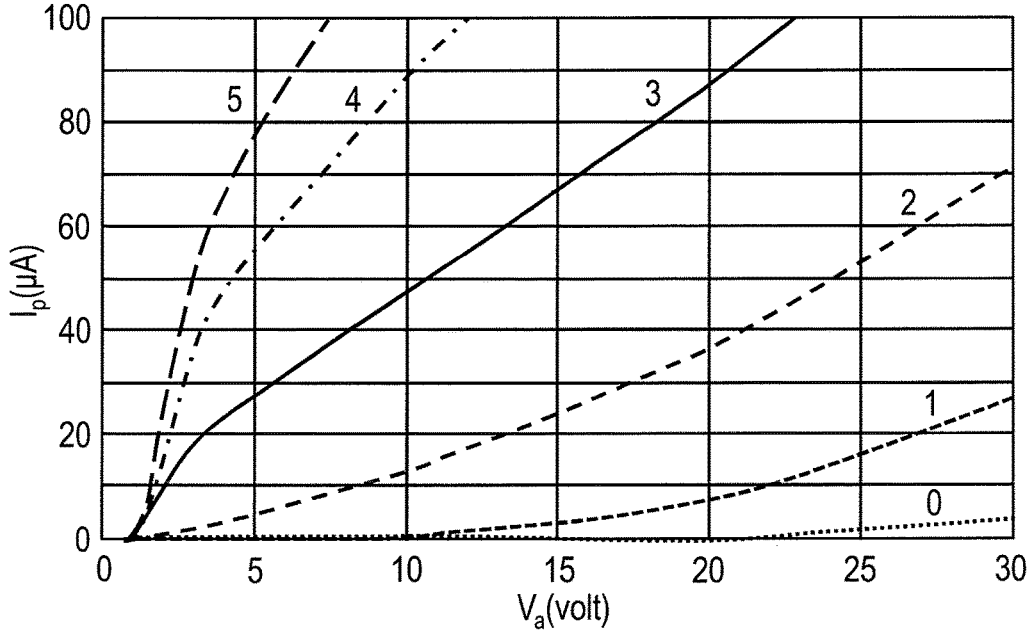
FIG. 13 is a diagram showing the relationship between the anode voltage $V_a$ and the current $I_p$ in the case where a distance between the anode and the grid is set to about 0.3 mm, and a distance between a filament and the grid is set to about 0.4 mm, for each voltage of the grid.

FIG. 13 shows the relationship between the anode voltage $V_a$ and the current $I_p$ in the case where the distance between the anode and the grid is set to about 0.3 mm, and the distance between the filament and the grid is set to about 0.4 mm, for each voltage. As can be seen from FIG. 13, a substantially linear amplification characteristic can be obtained within a range where the anode voltage $V_a$ is about 4V or higher if a bias voltage of an input signal is 3V, and a maximum value of amplitude of an input signal is 1V. Therefore, the vacuum tube can be utilized as a vacuum tube for analog amplification. Though an experiment example shown in the present application is shown only in FIG. 13, a vacuum tube which is easy to utilize for analog amplification in comparison with the general vacuum fluorescent display described with reference to FIG. 12 can be obtained if the distance between the filament 110 and the grids 130-1, 130-2 is between 0.2 mm and 0.6 mm, including 0.2 mm and 0.6 mm. In other words, if the second predetermined distance of the vacuum tube of the present invention is set between 0.2 mm and 0.6 mm, including 0.2 mm and 0.6 mm, a flow of electrons from a filament to anodes can be changed in an analog manner by electric potential of grids, and, therefore, the vacuum tube is easy to use as an analog amplifier.

Further, in the case where the distance between the anodes 120-1, 120-2 and the grids 130-1, 130-2 (the first predetermined distance) exceeds 0.35 mm, it is necessary that the grid support members 132-1, 132-2 are bent-formed. On the other hand, if the distance between the anodes and the grids (the first predetermined distance) is between 0.15 mm and 0.35 mm, including 0.15 mm and 0.35 mm, the grid support members 132-1, 132-2 can be configured only by performing blanking of flat board. In this case, since the distance between the anodes and the grids is determined by the board thickness of the grid support members, the grid support members 132-1, 132-2 can be formed with an accurate distance. Further, if the grid support members 132-1, 132-2 are bent-formed, the grids easily vibrate and cause noises. If the grid support members 132-1, 132-2 are formed by flat board punching, the vibration of the grids can be suppressed, and a vacuum tube which is easy to utilize for analog amplification can be obtained.

Further, as described above, if the filament is intermediately fixed, the wavelength of the vibration of the filament can be shortened, and, therefore, it is easy to increase the fundamental frequency of vibration of the filament. In other words, since it is easy to bring the frequency to a frequency insensible to a person, the vacuum tube is easy to use as an analog amplifier for sound signal. If the frequency of the characteristic vibration of the filament 110 is increased to 3 kHz or higher, noises resulting from the vibration of the filament 110 can be brought to a frequency inaudible to a person. Such frequency adjustment can be realized by adjusting material and thickness of the filament 110, the length from the welding points 112 to the intermediate filament fixing part 113 and the tension given by the anchors 115. It is desirable that the fundamental frequency is high, and if the fundamental frequency can be adjusted to be 10 kHz or higher, it is possible to prevent noises due to the vibration of the filament from being heard by a person.

What is claimed is:

1. A vacuum tube comprising a filament and two pairs of a grid and an anode, wherein the filament is tensioned linearly and emits thermoelectrons;

both of the anodes are formed on a same face of a planar substrate;

the filament is arranged parallel to the planar substrate at a position facing both of the anodes;

each of the grids is arranged, such that the grid faces the anode of a same pair at a first predetermined distance from the anode and has a second predetermined distance from the filament, between the anode and the filament;

the vacuum tube further comprises an intermediate filament fixing part fixing the filament at a position corresponding to an intermediate point between the anodes of the two pairs; and the intermediate filament fixing part is at a position that divides the filament into two halves.

2. A vacuum tube comprising a filament and two pairs of a grid and an anode, wherein the filament is tensioned linearly and emits thermoelectrons;

both of the anodes are formed on a same face of a planar substrate;

the filament is arranged parallel to the planar substrate at a position facing both of the anodes;

each of the grids is arranged, such that the grid faces the anode of a same pair at a first predetermined distance from the anode and has a second predetermined distance from the filament, between the anode and the filament;

the vacuum tube further comprises an intermediate filament fixing part fixing the filament at a position corresponding to an intermediate point between the anodes of the two pairs; and a fundamental frequency of characteristic vibration of the filament is 3 kHz or higher.

3. A vacuum tube comprising a filament and two pairs of a grid and an anode, wherein the filament is tensioned linearly and emits thermoelectrons;

both of the anodes are formed on a same face of a planar substrate;

the filament is arranged parallel to the planar substrate at a position facing both of the anodes;

each of the grids is arranged, such that the grid faces the anode of a same pair at a first predetermined distance from the anode and has a second predetermined distance from the filament, between the anode and the filament;

the vacuum tube further comprises an intermediate filament fixing part fixing the filament at a position corresponding to an intermediate point between the anodes of the two pairs; and the filament faces only the two pairs.

* * * * *